US005432312A

United States Patent [19]

Otani et al.

[11] Patent Number: 5,432,312

[45] Date of Patent: Jul. 11, 1995

[54] PUSH-LOCK DEVICES

[75] Inventors: Hiroki Otani; Akira Oyama, both of Miyagi; Masao Ohkita, Furukawa, all of Japan

[73] Assignee: Alps Electric Co., Ltd., Tokyo, Japan

[21] Appl. No.: 92,737

[22] Filed: Jul. 16, 1993

[30] Foreign Application Priority Data

Jul. 20, 1992 [JP] Japan ..... 4-050664 U

[51] Int. Cl.[6] ..... H01H 3/60; H01H 3/42

[52] U.S. Cl. ..... 200/524; 200/301

[58] Field of Search ..... 200/524, 523, 38 E, 200/301

[56] References Cited

U.S. PATENT DOCUMENTS

| | | | |
|---|---|---|---|
| 3,639,714 | 2/1972 | Fujimoto et al. | 200/524 X |
| 4,112,277 | 9/1978 | Kleeb | 200/524 |
| 4,404,436 | 9/1983 | Ohba . | |
| 4,482,791 | 11/1984 | Rendgen | 200/524 X |
| 4,636,601 | 1/1987 | Tanabe | 200/524 |

FOREIGN PATENT DOCUMENTS

| | | | |
|---|---|---|---|
| 3644437 | 5/1988 | Germany | 200/301 |

*Primary Examiner*—Renee S. Luebke

*Attorney, Agent, or Firm*—Guy W. Shoup; Patrick T. Bever

[57] ABSTRACT

A push-lock device has a damper mechanism 9 which includes a strip body 17; protruding portions 14, 16; a protruding portion 26; and a rubber ring 23. The strip body 17 is arranged in the moving direction of the sliding body 4 housed in the case 2 and has a meandering groove 22 formed therein. The protruding portions 14, 16 support rotatably the ends of the strip body 17. The protruding portion 26 is arranged to the sliding body 4 and engages to the meandering groove 22. The rubber ring 23 is arranged between the base **2*b* of the case 2 and one end of the strip body 17. The damper mechanism 9 can brake the movement of the sliding body 4** to prevent the sliding body from returning quickly from the locking position. The shock noise of the sliding body is reduced and the knob can be prevented from slipping out from the operating shaft.

9 Claims, 6 Drawing Sheets

PUSH-LOCK DEVICES

BACKGROUND OF THE INVENTION

1. Field of the Invention

The present invention relates to a push-lock device which is attached to an electrical component such as audio-devices for vehicles wherein when being pushed inwardly, an operating shaft protruding from the electrical component is maintained at a locking position and when being repushed inwardly, the operating shaft is released from the locking state.

2. Description of the Related Art

Generally, a push-lock device is constituted of a case attached to an electrical component such as a rotary-type variable resistor and a rotary switch, a sliding body housed movably in the case and having a cam groove so-called a heart-shaped cam, an operating shaft having one end coupled to the sliding body and inserted into the electrical component, a return spring for biasing the sliding body in the direction of the operating shaft, and an operating pin having one end supported upon the case and the other end being traceable along the cam groove.

In such a push-lock device, when the operating shaft protruding from an electrical component is depressed against the biasing force of a return spring, the sliding body moves and approaches to the moving end thereof and the operating pin traces along the cam groove of the sliding body, thus being latched at a predetermined position of the cam groove. As a result, the sliding body is held in a locking state by way of the operating pin. Sequentially, when the operating shaft is depressed again, the operating pin is unlocked from the predetermined position of the cam groove, whereby the sliding body is released from the locking state. Since this step can house the operating shaft inside a panel, the beauty of mobile audio-apparatus or the like can be improved. Furthermore, a careless mistake that an operator inadvertently hits and catches on the operational shaft can be prevented by removing, if necessary, the protruding state of the operating shaft.

However, in the conventional push-lock device, when the operating shaft in a locking position is redepressed and then released, the operating shaft and the sliding body are returned quickly by the biasing force of the return spring. For that reason, there are problems in that a hit of the sliding body against the moving end produces an impact noise and the knob inserted in the end of the operating shaft comes out.

SUMMARY OF THE INVENTION

The present invention is made to overcome the above problems associated with the prior art. An object of the present invention to provide a push-lock device which can prevent that a sliding body withdraws quickly from the locking position to the lock releasing position.

In order to achieve the above object, a push-lock device according to the present invention is constituted of a case; a sliding body housed movably in the case and having a cam groove; an operating shaft coupled to the sliding body; a return spring for biasing the sliding body toward the axial direction of the operating shaft; an operating pin having one end supported upon the case and the other end being slidable along the cam groove; whereby when the operating shaft is depressed inwardly against the biasing force of the return spring, the operating pin is latched at a predetermined position of the cam groove so that the sliding body is maintained in a locking state; and when the operating shaft is repushed inwardly, the locking state of the sliding body is released; and a damper mechanism for braking the movement of the sliding body.

Since the push-lock device of the present invention has the above structure, the damper mechanism cam can brake the movement of the sliding body when the sliding body is returned by the biasing force of a return spring. For that reason, the sliding body can be prevented from returning quickly from the locking position to the lock releasing position.

BRIEF DESCRIPTION OF THE DRAWINGS

The present invention will hereinafter be explained in more detail with reference to the attached drawings, wherein.

DESCRIPTION OF THE PREFERRED EMBODIMENTS

A preferred embodiment of the push-lock device according to the present invention will be explained below in accordance with attached drawings.

Figure 1:
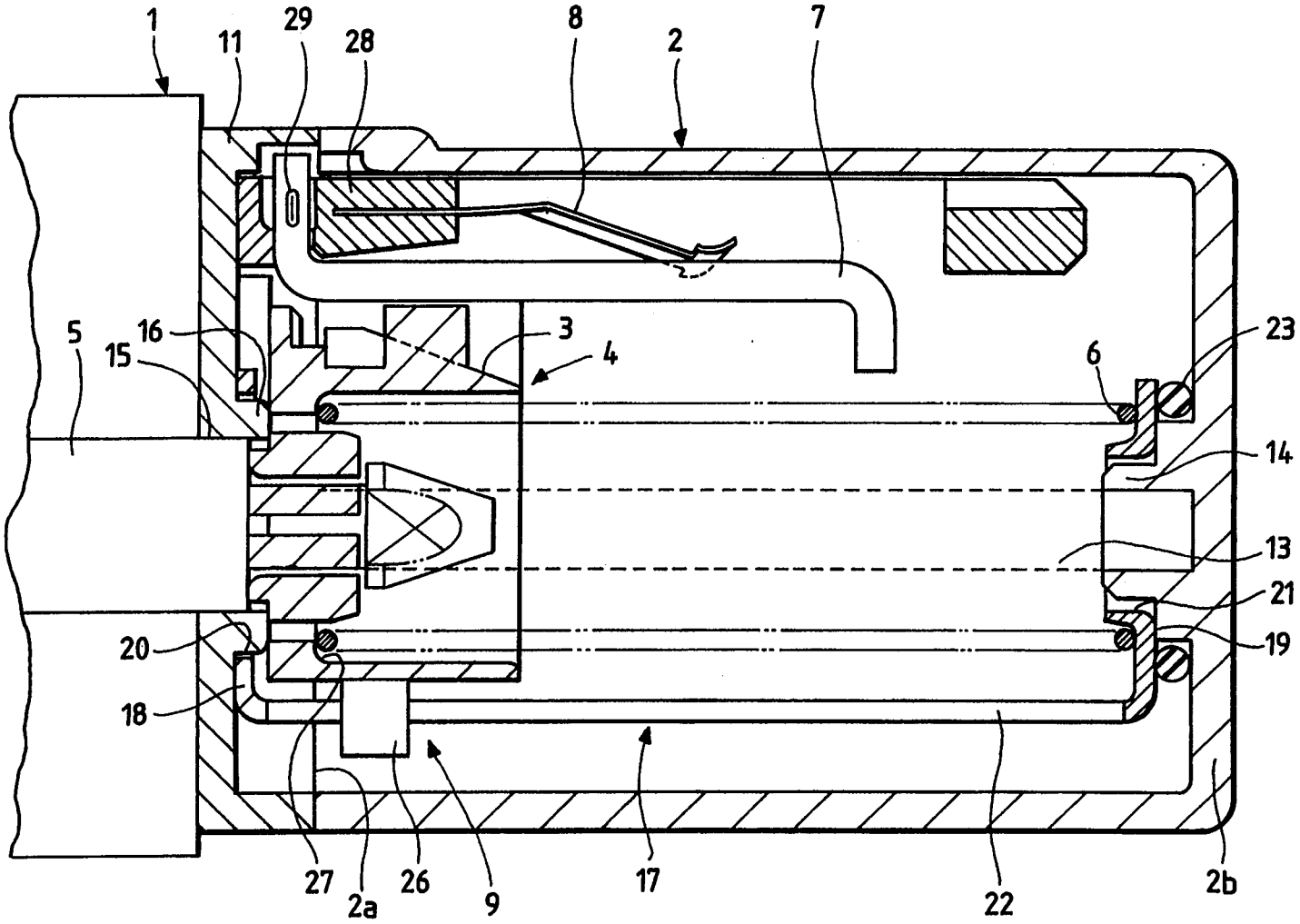
FIG. 1 is a cross-sectional view in the axial direction showing a push-lock device according to a first embodiment of the present invention.
Figure 2:
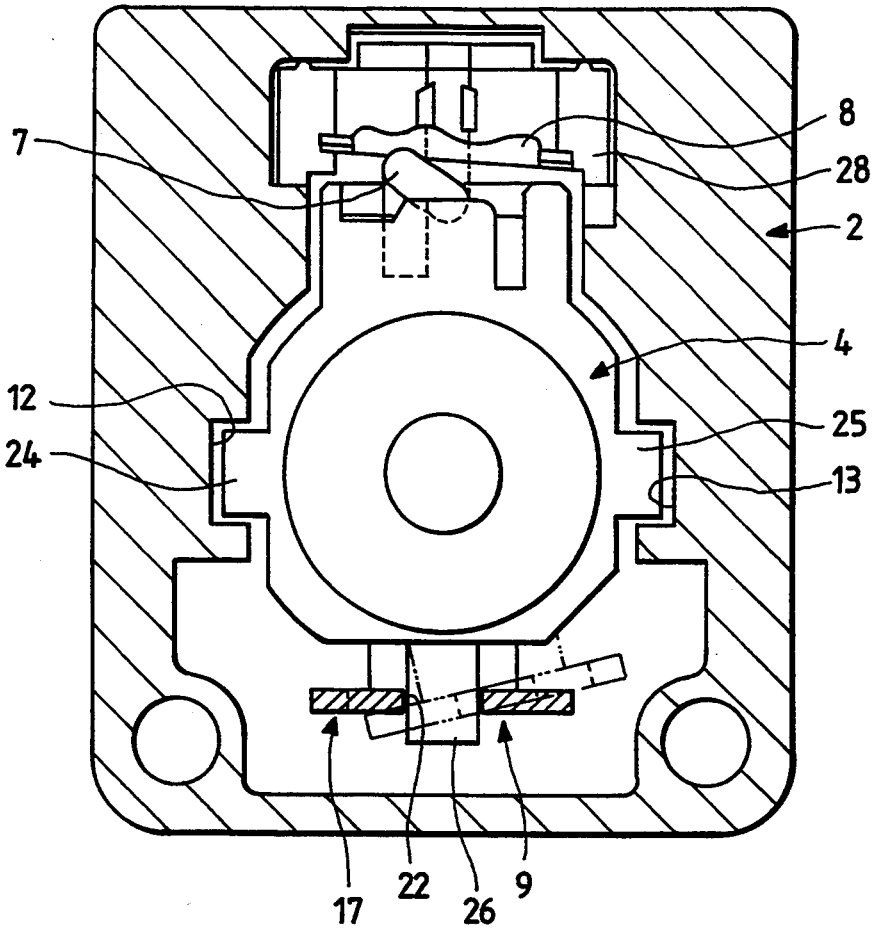
FIG. 2 is a cross-sectional view in the direction perpendicular to the axial direction, showing the push-lock device in FIG. 1.
Figure 3:
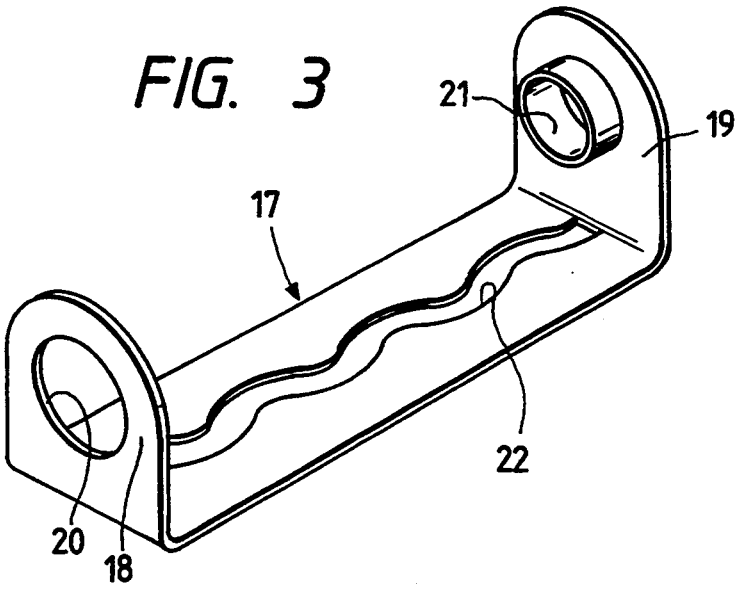
FIG. 3 is a perspective view showing a strip body equipped with the push-lock device in FIG. 1.
Figure 4:
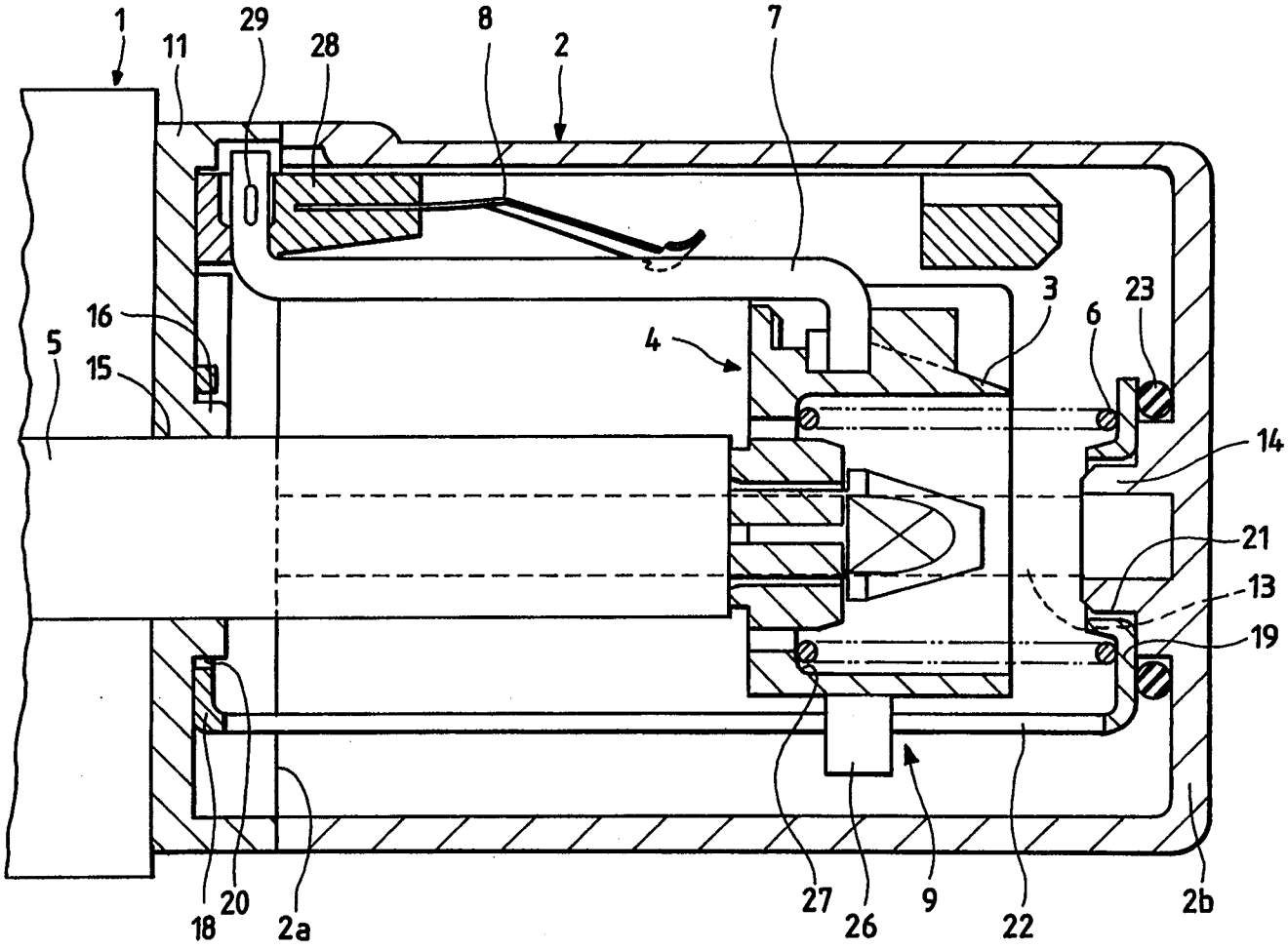
FIG. 4 is a cross-sectional view showing a locked state of the sliding body equipped with the push-lock device in FIG. 1.

FIG. 1 is a cross-sectional view in the axial directional showing a push-lock device according to the first embodiment of the present invention. FIG. 2 is a cross-sectional view in the direction perpendicular to the axial direction showing the push-lock device in FIG. 1. FIG. 3 is a perspective view showing the strip body equipped with the push-lock device in FIG. 1. FIG. 4 is a cross-sectional view in the axial direction showing a locking state of the sliding body equipped to the push-lock device in FIG. 1.

The push-lock device according to the present embodiment shown in FIG. 1 is constituted of a case 2 arranged adjacent to an electrical component 1, a sliding body 4 housed movably in the case 2 and having cam groove 3 on the upper portion in FIG. 1, an operating shaft 5 having one end coupled to the sliding body 4 and inserted in the electrical component 1, a return spring 6 for biasing the sliding body 4 in the direction of the operational shaft 5, an operational pin 7 having one end supported by the case 2 and the other end being traceable along the cam groove 3, a leaf spring 8 for biasing the operating pin 7 toward the cam groove 3, and a braking mechanism 9 for braking the movement of the sliding body 4. A knob (not shown) is inserted in the other end of the operating shaft 5. The knob protrudes out of the surface of a panel (not shown) in the lock releasing state shown in FIG. 1, and is withdrawn in the panel surface in the locking state as shown in FIG. 4.

The case 2 is mounted integrally with an electrical component 1 by way of the covering body 11 which covers the open end 2*a* of the case 2. A pair of grooves 12 and 13, as shown in FIG. 2, are formed on the inner sides of the case 2 and along the moving direction of the sliding body 4. A cylindrical protruding portion 14 arranged on the same axis as the operating shaft 5, as shown in FIG. 1, is formed, on the base portion 2*a* of the case 2. The covering body 11 has a through hole 15 for passing through the operating shaft 5, and another protruding body 16 formed around the through hole 15 and confronting the protruding portion 14. A strip body 17 is arranged between the base portion 2*b* of the case 2 and the covering body 11 and along the sliding direction of the sliding body 4. The strip body 17, as shown in FIG. 3, has bent portions 18 and 19 at the ends thereof which have round holes 20 and 21 for receiving the protruding portions 14 and 16, respectively. The strip body 17 also has a meandering groove 22 formed in the elongated direction. A rubber ring 23 is arranged between the base portion 2*b* of the case 2 and the bent portion 19.

The sliding body 4, as shown in FIGS. 1 and 2, includes guiding portions 24 and 25 protruding from sides thereof and being received in the guide grooves 12 and 13, a protruding portion 26 protruding downwards and engaging with the meandering groove 22, and a spring seating portion 27 for seating one end of the return spring 6. The operating pin 7 has one end formed as an escape stopping protrusion 29 which is bent upward at a right angle and is fixed to the supporting body 28, and has a free end bent downward at a right angle. The protruding portions 14 and 16 constructs supporting means for supporting rotatably the bent portions 18 and 19 at both the ends of the strip body 17. Furthermore, the damper mechanism is constructed of the strip body 17, the protruding portions 14 and 16, the protruding portion 26, and the rubber ring 23.

According to the first embodiment, when the sliding body 4 is in a lock releasing state as shown in FIG. 1, the operating shaft 5 is depressed against the biasing force of the return spring 6 so that the sliding body 4 advances, while being guided along the guide grooves 12 and 13. In this case, the protruding portion 26 of the sliding body 4 slides in the meandering groove 22 of the strip body 7 to rock the strip body 17. Since the operating pin 7 is biased toward the sliding body 4 by means of the leaf spring 8, the free end of the operating pin 7 traces along the cam groove 3 of the sliding body 4. When the sliding body 4 advances to the moving end to release the depressed state of the operating shaft 5, the sliding body 4 is pushed back a little by the biasing force of the return spring 6, whereby the free end of the operational pin 7, as shown in FIG. 4, is latched at a predetermined position of the cam groove 3. As a result, the sliding body 4 is maintained at the locking position by means of the operating pin 7.

On the other hand, as shown in FIG. 4, when the sliding body 4 is in a locked state and the operating shaft 5 is pushed inwardly again, the sliding body 4 is pushed back to the lock releasing position shown in FIG. 1 from the locked position shown in FIG. 4 by means of the biasing force of the return spring 6 since the operating pin 7 is unlocked at the predetermined position of the cam groove 3 to release the locking state of the sliding body 4. Then since the protruding portion 26 of the sliding body 4 slides along the meandering groove 22 in the strip body 17 to slide the strip body 17, the energy due to the biasing force of the spring 6 is absorbed by the sliding resistance between the protruding portion 26 and the meandering groove 22, the sliding resistance between the bent portion 18 and the covering body 11, the sliding resistance between the bent portion 19 and the rubber ring 23, and the rocking inertia of the strip body 17, whereby the movement of the sliding body 4 is braked.

According to the first embodiment having the above structure, since the damper mechanism can brake the movement of the sliding body 4, it can be prevented that the sliding body 4 returns quickly from the locking position shown in FIG. 4 to the lock releasing position shown in FIG. 1. When the sliding body 4 is at the locking position shown in FIG. 4, it can be prevented that the sliding body 4 fails to return from the state since the return spring 6 stores a sufficiently strong compressed resilient force. On the other hand, when the sliding body 4, shown in FIG. 1, is in the lock releasing position, the operating shaft 5 can be pushed inwardly by a small force in the state and without degrading the operability at pushing since the resilient force of the return spring 6 is weaker than the locking position shown in FIG. 4. In the push-lock operation, since the pushing operation is carried out with a finger, the sliding body 4 is not struck at an impact speed so that the damper mechanism 9 has good pushing operability.

Figure 5:
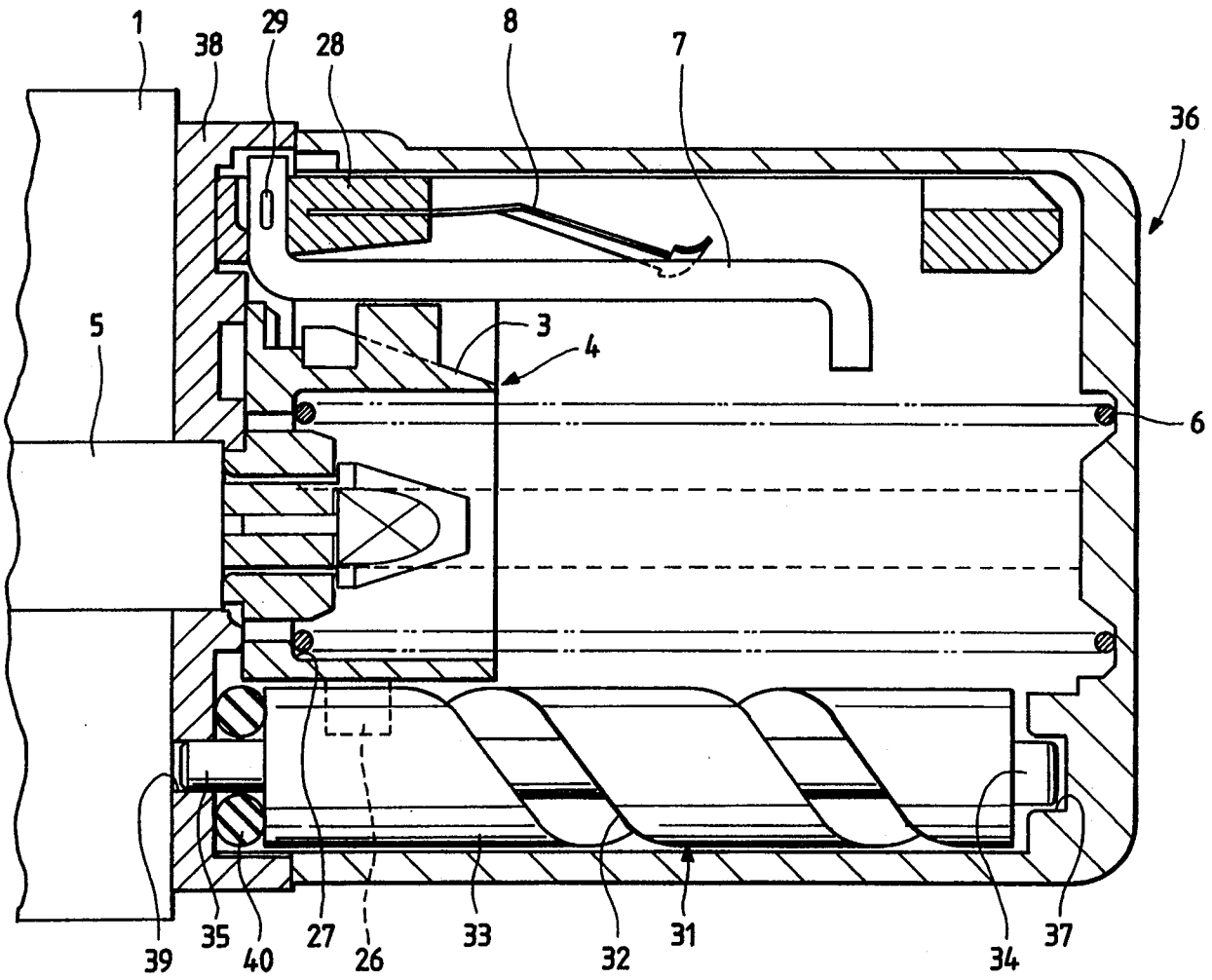
FIG. 5 is a cross-sectional view in the axial direction showing the second embodiment of the push-lock device according to the present invention.
Figure 6:
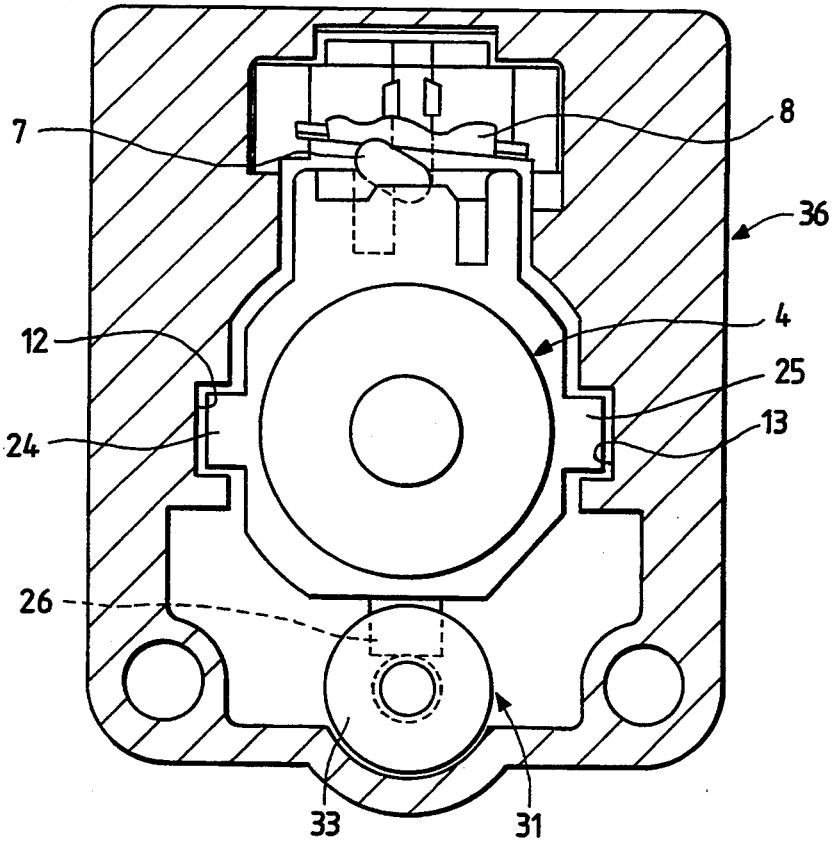
FIG. 6 is a cross-sectional view in the direction perpendicular to the axial direction, showing the push-lock device shown in FIG. 5.
Figure 7:
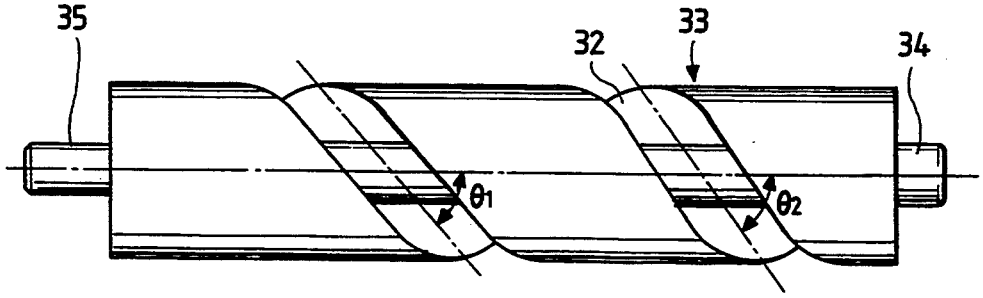
FIG. 7 is a front view of the column body equipped with the push-lock device shown in FIG. 6.
Figure 8:
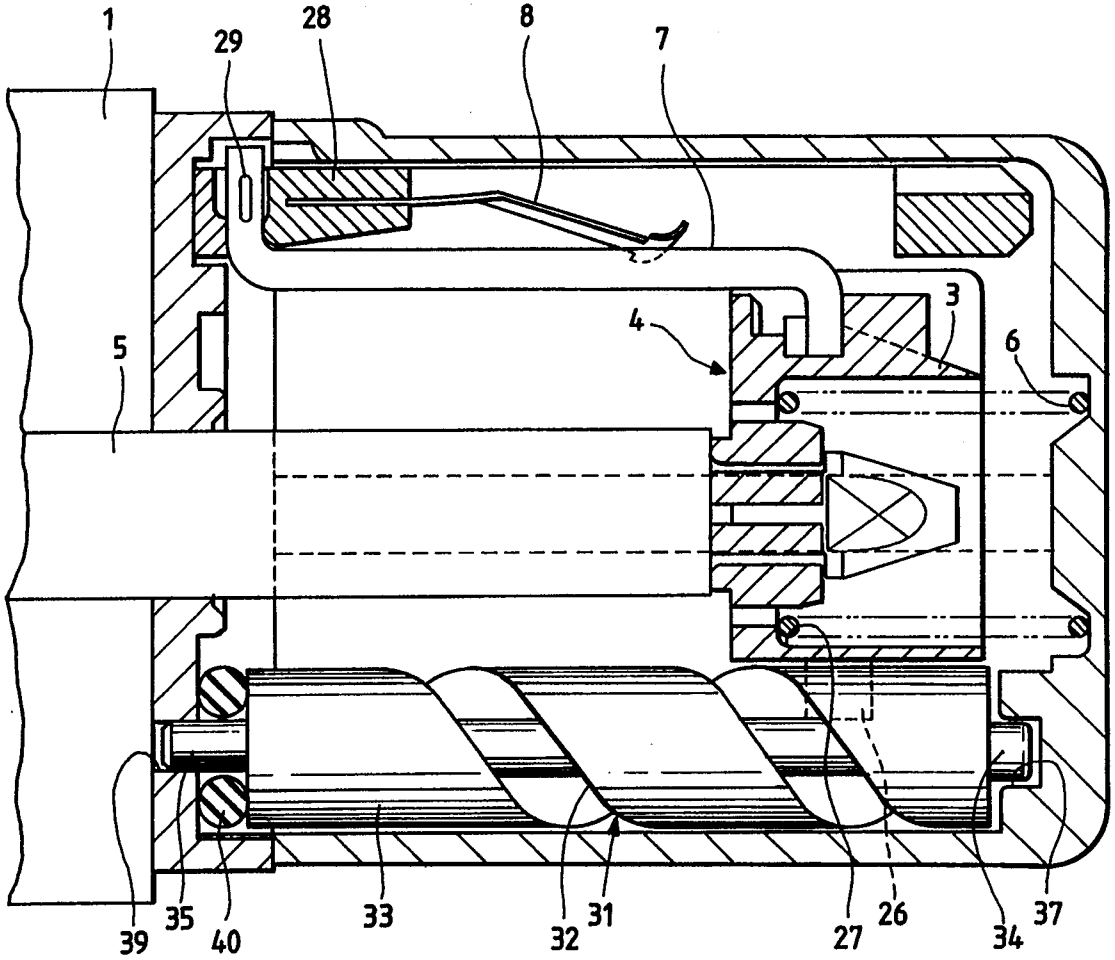
FIG. 8 is a cross-sectional view in the axial direction showing a locking state of the sliding body equipped with the push-lock device in FIG. 5.

FIG. 5 is a cross-sectional view showing the push-lock device according to the second embodiment of the present invention. FIG. 6 is a cross-sectional view in the direction perpendicular to the axial direction of the push-lock device in FIG. 5. FIG. 7 is a front view showing the column body equipped with the push-lock device in FIG. 6. FIG. 8 is a cross-sectional view in the direction perpendicular to the axial direction showing in a locked state of the sliding body equipped in the push-lock device. Like numerals are attached to elements corresponding to those shown in FIGS. 1 to 4. That is, numeral 1 represents an electrical component, 3 represents a cam groove, 4 represents a sliding body, 6 represents a return spring, 7 represents an operating pin, 8 represents a leaf spring, 12 and 13 represent a guide groove, 24 and 25 represent a guide portion, 26 represents a protruding portion, 27 represents a spring portion, 28 represents a supporting body, and 29 represents an escape stopping protrusion.

In comparison with the first embodiment, in the push-lock device of the present invention shown in FIG. 5, the damper mechanism 31 for braking the movement of the sliding body 4 includes a column body 33 arranged along the moving direction of the sliding body 4 and having a spiral 32 engaged to the protruding portion 26 formed therein, supporting means for supporting rotatably the protruding shafts 34 and 35 on both the ends of the column body 33, a hole 37 formed in the base portion of the case 36, for example, and a hole 39 formed in the covering body 38, and a rubber ring 40 inserted between one end of the column body 33 and the covering body 38. The slanting angle of the spiral groove 32, shown in FIG. 7, is set so as to increase gradually from the opening side (on the left side in FIG. 7) of the case 36 to the base portion side (on the right side in FIG. 7) and, namely, is set so as to be at the slanting angle $\theta_2$ of the base portion side with respect to the case 36 larger than the slanting angle $\theta_1$ of the opening side with respect to the case 36.

In the second embodiment, as shown in FIG. 5, when the operating shaft 5 in a lock releasing state is pushed inwardly against the biasing force of the return spring 6, the sliding body 4 advances while being guided along the guide grooves 12 and 13. Then the protruding portion 26 of the sliding body 4 slides along the spiral groove 32 in the column body 33 while the column body 33 rotates. In this case, since the column body 33 is depressed toward the base portion of the case 36, the force which depresses the rubber ring 40 arranged on the opening side of the case 36 decreases, whereby the sliding resistance between the rubber ring 40 and the covering body 38 reduces to a relatively small value. Since the operating pin 7 is biased toward the sliding body 4 by means of the leaf spring 8, the free end of the operating pin 7 traces along the cam groove 3 of the sliding body 4. When arriving at the moving end, the sliding body 4, as shown in FIG. 8, is released from the depressed state of the operating shaft 5 and backlashed a little by the biasing force of the return spring 6 so that the free end of the operating pin 7 is latched at a predetermined position of the cam groove 3. As a result, the sliding body 4 is maintained at the locking state by way of the operating pin 7.

On the other hand, when the sliding body 4 is in a locked state as shown in FIG. 4, the operating shaft 5 is depressed again so that the operating pin 7 is unlocked from the predetermined position of the cam groove 3 to release the locking state of the sliding body 4. Then the sliding body 4 is pressed back from the locking position shown in FIG. 8 to the lock releasing position shown in FIG. 5 by means of the biasing force of the return spring 6 while the protruding portion 26 of the sliding body 4 slides in the direction of the opening of the case 36. With the movement, since the column body 33 is driven in the direction of the opening of the case 36 and rotated, the the depressing force against to the rubber ring 40 increases while the the sliding resistance of the rubber ring 40 becomes relatively large. In this case, since the rotational energy of the column body 33 is absorbed relatively by the sliding resistance of the rubber ring 40 and the sliding resistance between the protruding portion 26 and the spiral groove 32, the movement of the sliding body 4 is braked.

In the second embodiment formed thus, since the damper mechanism 31 can brake the movement of the sliding body 4, it can be prevented that the sliding body returns quickly from the locked position shown in FIG. 8 to the lock releasing position shown in FIG. 5. When the sliding body 4 is at the locked state shown in FIG. 8, since the return spring 6 is sufficiently compressed to store a strong resilient force, it can be prevented that the sliding body 4 fails to return to the locked position from the above state. When the sliding body 4 is at the lock releasing position shown in FIG. 5, the resilient force of the return spring 6 is reduced while the slanting angle of the spiral groove 32 is relatively small so that the sliding resistance is small. Since the rubber ring 40 has a small sliding resistance, the column body 33 is rotated by a small force, whereby the operability of the operating shaft 5 does not degrade when the operating shaft 5 is depressed. Moreover, the resilient force of the return spring 6 can be balanced by setting the slanting angle of the spiral groove 32 at a desired value.

Since the push-lock device of the present invention has as the above mentioned structure, it can be prevented that the sliding body returns quickly from the locked position to the lock releasing position. Hence when the sliding body strikes against the moving end at the lock releasing position, it can be prevented that the impact noise occurs and the knob attached to the operating shaft falls out.

What is claimed is:

1. A push-lock device comprising:

a case;

a sliding body housed movably in said case, said sliding body having a cam groove and a protrusion;

an operating shaft coupled to said sliding body;

a return spring for biasing said sliding body along an axial direction of said operating shaft;

an operating pin having one end supported by said case and the other end being slidable along said cam groove;

whereby when said operating shaft is pushed inwardly against the biasing force of said return spring, said operating pin is latched at a predetermined position of said cam groove so that said sliding body is maintained in a locking state, and when said operating shaft is repushed inwardly, the locking state of said sliding body is released; and a damper mechanism for braking a movement of said sliding body, said damper mechanism including an elongated member arranged along a traveling direction of said sliding member, said elongated member defining a non-linear groove receiving said protrusion of said sliding body.

2. A push-lock device according to claim 1, wherein said elongated member of said damper mechanism comprises a strip body, said non-linear groove being a meandering groove formed on said strip body; and wherein said case further includes means for rotatably supporting said strip body.

3. A push-lock device according to claim 2, further comprising friction means mounted between said strip body and said case for restricting a rotating movement of said strip body relative to said case.

4. A push-lock device according to claim 3, wherein said friction means is located at an end of said strip body.

5. A push-lock device according to claim 4, wherein said friction means comprises an O-ring.

6. A push-lock device according to claim 1, wherein said elongated member of said damper mechanism comprises a column body said non-linear groove being a spiral groove formed on said column body, and wherein said case further includes means for rotatably supporting ends of said column body.

7. A push-lock device according to claim 6, further comprising friction means mounted between said column body and said case for controlling a rotation of said column body relative to said case.

8. A push-lock device according to claim 7, wherein said friction means is located at an end of said column body.

9. A push-lock device according to claim 8, wherein said friction means comprises an O-ring.

* * * * *